United States Patent [19]

Prikkel, III

[11] 4,290,552

[45] Sep. 22, 1981

[54] DAMPER CONTROL MECHANISM

[76] Inventor: John Prikkel, III, 2952 Ensley Ave., Dayton, Ohio 45414

[21] Appl. No.: 178,164

[22] Filed: Aug. 14, 1980

[51] Int. Cl.[3] ..... F23N 3/00

[52] U.S. Cl. ..... 236/1 G; 110/163; 126/285 B

[58] Field of Search ..... 236/1 G, 68 R; 126/285 B; 110/163; 431/20

[56] References Cited

U.S. PATENT DOCUMENTS

| | | | |
|---|---|---|---|
| 4,114,805 | 9/1978 | Humphreys et al. | 236/1 G |
| 4,165,833 | 8/1979 | Nagel | 236/1 G |
| 4,175,695 | 11/1979 | Cresswell | 236/1 G |
| 4,190,197 | 2/1980 | Werne | 236/1 G |

*Primary Examiner*—Edward G. Favors
*Attorney, Agent, or Firm*—Dybvig & Dybvig

[57] ABSTRACT

For use in a ventilation flue or the like, a damper positioning mechanism comprising a yieldable means biasing said damper toward a first position, motive means for opposing the bias of said yieldable means to drive said damper to a second position and thermally responsive means modulating the return of said damper from said second position to said first position, said thermally responsive means being strong in relation to said yieldable means. In one embodiment the thermally responsive means resists closure of said damper until exposed to a sufficiently low temperature. In another embodiment the thermally responsive means resists opening of said damper until exposed to a sufficiently high temperature.

10 Claims, 8 Drawing Figures

DAMPER CONTROL MECHANISM

BRIEF SUMMARY OF THE INVENTION

In the present invention, yieldable means urges a damper rotatable in the passageway of a duct to a first position and motive means, such as an electromagnetically driven armature, is energizable to move the damper against the bias of said yieldable means to a second position whereafter, with de-energization of said motive means, said yieldable means acts to return said damper to the first position. In one embodiment the first position is a ventilation duct closure position and the motive means, when energized, overpowers the spring means to move the damper to a position opening the duct passageway. The duct has a fixedly mounted stop member against which the motive means pushes the damper to establish the open position and drivingly connected to the damper is a thermally responsive member which, in response to increasing temperature, moves with respect to the stop element to initially limit return of said damper to the duct closure position, such initial limitation on damper closure diminishing with diminishing temperature, the thermally responsive member thus functioning to delay damper closure.

In a modification, the motive means, when energized, drives the damper to a position closing a duct passageway and when the motive means is de-energized, the return spring biases the damper toward a position opening the duct passageway, the duct opening position being established by a suitably located stop mounted to the duct. A thermally responsive member drivingly connected to the damper initially opposes movement of the damper to its duct opening position by reason of engagement with a stop element. When exposed to increasing temperatures, however, the thermally responsive member moves with respect to said damper to alllow a closer approach of said damper to said stop element as the damper approaches a position fully opening said duct, the thermally responsive member thus serving to delay the opening of said duct.

BRIEF DESCRIPTION OF THE DRAWINGS

In the drawings:

FIG. 2 illustrates with solid lines the damper closed and by means of an arrow illustrates the direction of damper movement to its open position where the damper is illustrated with broken lines. FIG. 3 illustrates the damper in its open position with an arrow indicating the effect of heat on a thermally responsive coil associated with the damper. FIG. 4 schematically illustrates a possible position assumed by the damper shortly after a heat demand of the thermostatic control has been satisfied.

FIGS. 6, 7 and 8 are vertical section views with the environmental duct being shown by solid lines, with the diagrammatical illustration of the control apparatus simplified and wherein FIG. 6 illustrates the damper closed at commencement of combustion, FIG. 7 illustrates by means of an arrow the direction in which a thermally responsive element opens the damper in response to increasing temperatures and FIG. 8 illustrates the fully open position reached by the damper after continued combustion.

DETAILED DESCRIPTION

Figure 1:
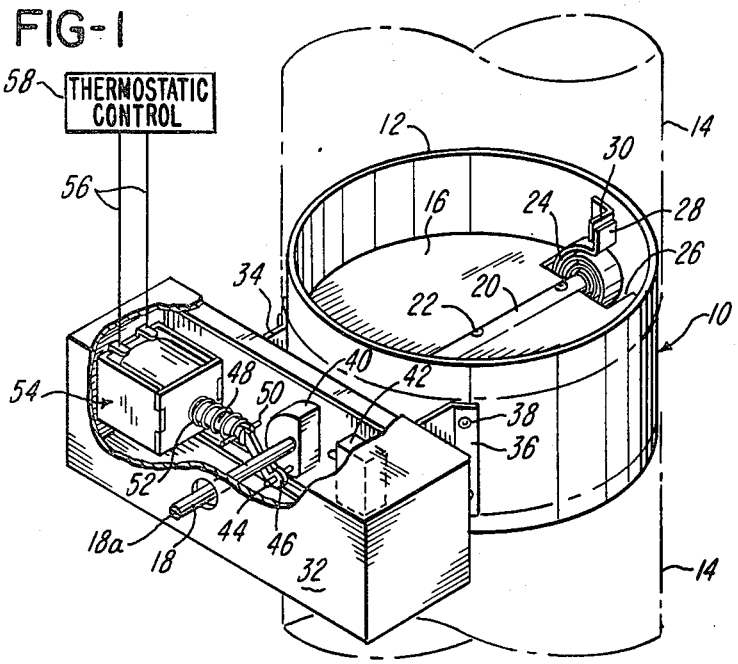
FIG. 1 is a schematic perspective illustration of the present invention with a duct environment, in which the apparatus is designed to operate, fragmentarily illustrated with phantom lines and with a thermostatic control diagrammatically illustrated.

U.S. Pat. No. 4,108,369, issued to the inventor herein, discloses an automatic damper mechanism including a solenoid, or other motive means, for positioning a damper rotatably mounted within a flue duct. The motive means for positioning the damper operates against a spring, or the like, whereby when the motive means is disabled or de-energized, the spring, or the like, returns the damper to its starting position. By way of illustration, the aforesaid patent illustrates a starting position in which the damper substantially closes a flue duct and energization of the motive means causes the motive means to drive the damper to a duct opening position, the operation of the motive means being controlled by a thermostat device located in a space whose temperature is to be controlled. In the present invention, a similar arrangement of motive means and spring means acting in opposition with thermostatic control of the motive means may be employed but with the addition of thermally responsive means, more powerful than the aforementioned spring means, for modulating the action of the spring means. Thus, in accordance with the present invention, a flue duct may be opened directly and positively by operation of motive means and thereafter closed in a modulated fashion by action of the spring, or the like, against a thermally responsive element which resists damper closure in accordance with the temperature of the thermally responsive element. Alternately, as will be explained in connection with the modification, the modulation of the damper position may be used during damper opening as opposed to damper closing.

FIGS. 1, 2, 3 and 4 illustrate adaptation of the present invention for delaying closure of a damper, such closure delay being useful in the flues associated with oil burners and the like, wherein it is desirable to allow a substantially complete ventilation of combustion products before damper closure is accomplished. The delayed closure mechanism is identified in FIG. 1 by the reference number 10 and comprises a housing 12 adapted to be inserted in a flue duct 14. Illustrated in FIG. 1, in a duct closing position, is a damper plate 16 drivingly attached to a shaft 18 nested in a trough 20 extending diametrically across the damper plate 16 and said shaft 18 being fixed to the damper plate 16 by means of rivets 22. The shaft 18 is elongated so as to extend outboard of the housing 12 for purposes to be described.

The end of the shaft 18, terminating within the housing 12, is drivingly connected to the innermost convolution of a bimetallic thermally responsive coil 24. To this end, the shaft 18 may have a bifurcation, identified by the reference number **18*a* in FIG. 2, through which is passed the innermost convolution of the coil 24**.

As apparent in FIG. 1, the damper plate 16 has a notch 26 in its otherwise circular periphery which accomodates the size of the coil 24.

The outermost convolution of the convoluted coil 24 terminates with an upstanding tab 28 which, at times, engages one flange of a stop element 30 whose other flange is affixed by riveting to the interior wall of the housing 12. It will be appreciated that the coil 24 is unsupported except by its driving attachment to the shaft 18, which shaft may be journalled in diametrically opposite wall portions of the housing 12. The outboard end of the shaft 18 passes through a box or shelter 32 disposed outboard of the housing 12.

Projecting outwardly from one side of the box 32 are plates 34, having flanges 36, riveted by rivets 38 to the outside wall of the housing 12, thus to fixedly space the box 32 from the housing 12. Within the box 32 the shaft 18 is surrounded by and drivingly engaged to a cam 40, the motions of which cam may be sensed at one extreme of such motion by a limit switch 42. Press-fitted to the cam 40 is a pin 44, swingably engaged to a link 46 adjacent one end of such link. The opposite end of the link 46 is pivotally engaged to an armature 48 by means of a retainer pin 50, which retains the link 46 in a bifurcated end portion of the armature 48.

The opposite end of the armature 48 is slidably fitted in the core structure of a solenoid mechanism 54 which, when energized, attracts the armature 48 inwardly of the solenoid mechanism. Such inward movement of the armature 48 is resisted by a spring 52 surrounding the armature 48, engaged at its outer end by the retainer pin 50 and engaged at its inner end by the core structure of the solenoid mechanism 54. Energization of the solenoid mechanism 54 is controlled by a thermostatic control 58 which may be a simple thermally responsive switch connected to the solenoid mechanism by conductors 56. Associated with the thermostatic control 58 is a source of voltage, not shown, which is connected to energize the solenoid mechanism 54 at times. It will be understood by those skilled in the art that the thermostatic control 58, schematically represented in FIG. 1, may be located in a space whose temperature condition is being controlled by a suitable combustion mechanism, not shown, the exhaust gases from which are vented through the duct 14.

Figure 2:
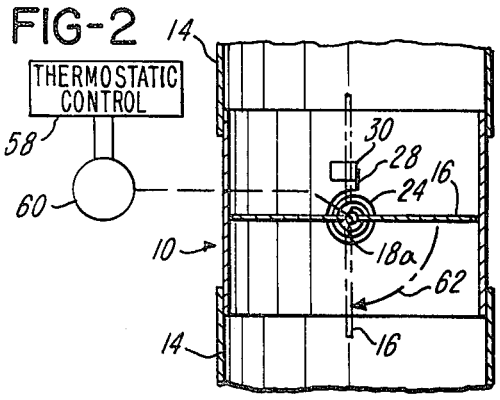
FIGS. 2, 3 and 4 are vertical section views of the apparatus with the environmental duct shown in solid lines and the thermostatically regulated control mechanism simplified.

At times when the thermostatic control 58 senses a need for heat in the space being controlled, the solenoid mechanism 54 is energized to pull the armature 48 inwardly and thus compress the spring 52 and, at the same time, rotate the damper plate 16 from the closed position illustrated in FIG. 1 to the open position illustrated with broken line in FIG. 2, whereupon the limit switch 42 is activated to commence combustion.

As combustion occurs, a heat exchange mechanism, not illustrated, delivers a portion of the heat resulting from combustion to the space monitored by the thermostatic control 58. Upon satisfaction of the thermostatic control 58 as to the temperature in the space monitored thereby, the thermostatic control interrupts the delivery of electrical power to the solenoid mechanism 54. Upon such power interruption, the spring 52 drives the armature 48 outwardly of the solenoid mechanism 54 and, in so doing, returns the link 46 and with it the cam 40 to the position illustrated in FIG. 1. As this return motion occurs, the limit switch 42 is released to prevent the occurrence of any combustion at times when the damper plate 16 is in its closed position.

Those skilled in the art will appreciate that the operation of a motive means, such as the indicated solenoid mechanism 54, in relation to a thermostatic control, such as the indicated control 58, and a damper plate, such as indicated damper plate 16, may be considerably more complex than outlined above. Thus the preceding description indicates that the initiation and termination of combustion is controlled by the limit switch 42. It is to be appreciated, however, that the initiation or termination of combustion may be controlled directly by the thermostatic control, and, when used, the limit switch 42 may be used for the accomplishment of other functions, sometimes merely damper position reporting functions.

Of concern in damper control apparatus of the type being described is the possibility that the closure of the duct 14, following the termination of combustion, will be too abrupt and an undesirable quantity of combustion products will be trapped in the duct 14 upstream of the damper plate 16. This can result undesirably in the leakage of combustion products to portions of the space being heated.

In accordance with the present invention, premature damper closure is avoided through use of the thermally responsive coil 24. The coil 24, which may be a strip of bimetal winding spirally about the shaft 18, is provided with an outwardly projecting tab 28 at the outermost convolution of such coil, the tab 28 being sized to, at times, engage a stop 30.

Figure 3:
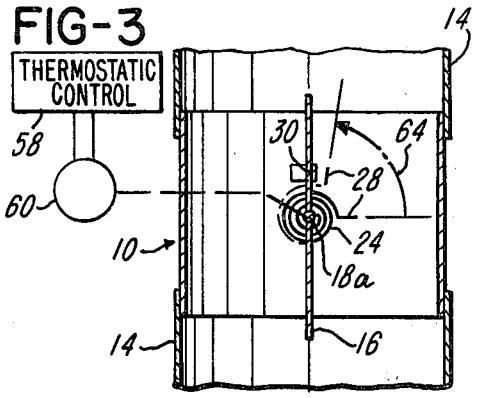
Figure 4:
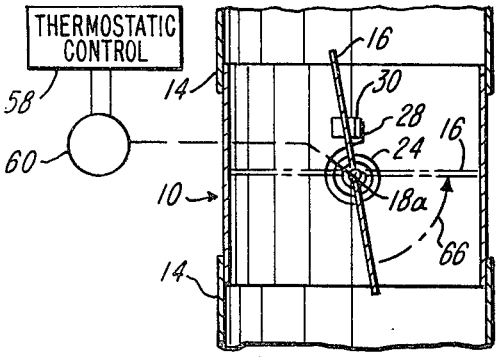

FIGS. 2, 3 and 4, together with FIG. 1, illustrate operating conditions. FIG. 1 shows the damper plate 16 closed long after any thermostatic heat demand has been satisfied and thus at a time when the occurrence of a thermostatic heat demand may be imminent. It can be noted that, at this time, the bimetal tab 28 is in proximity to the stop 30.

After the space being monitored by the thermostatic control 58 has cooled sufficiently to cause the thermostatic control to initiate a demand for heat, that control applies a voltage to the conductors 56 for energizing the solenoid mechanism 54. This causes the solenoid mechanism 54 to attract to itself the armature 48 and the resulting armature motion acts through the link 46 to rotate the cam 40 and, at the same time, compress the spring 52, the rotation of the cam 40 being transmitted to the damper plate 16 through the agency of the shaft 18. The resulting damper plate position is schematically illustrated in FIG. 2. In this Figure, the current carrying coil for the solenoid mechanism 54 is shown schematically as a circle representative of a wound solenoid coil 60. The bifurcated end **18*a* of the shaft 18 is shown as engaged to the innermost convolution of the thermally responsive coil member 24. The broken line between the solenoid coil 60 and the bifurcated end 18*a* of the shaft 18 indicates that the damper shaft is caused to rotate in response to energization of the coil 60. The arrow 62 indicates the direction of damper rotation produced by energization of the solenoid coil 60. The resulting position of the damper plate 16 is illustrated in FIG. 2** with broken lines.

The solid lines in FIG. 2 illustrate the position of the damper plate 16 and the thermally responsive coil 24 before energization of the solenoid coil 60. It can be noted that the extent of the damper plate rotation in response to energization of the coil 60 would be approximately 90°. Since the coil 60 is drivingly connected with the damper shaft 18, the tab 28 will likewise be rotated approximately 90° in the clockwise direction so as to follow the rotation of the damper plate 16 while lagging approximately 90° behind the damper plate.

The rotation of the damper plate 16 illustrated in FIG. 2 is, of course, accompanied by a 90° rotation of the cam 40 which actuates the limit switch 42.

The actuation of the limit switch 42 initiates combustion whereafter combustion products flow upwardly in the duct 14, such that a portion of the heat contained in such combustion products is transferred to the wall of the duct 14 and also to the convolutions of the bimetallic coil 24. As the temperature of the bimetallic coil 24 increases, its overall length increases with the consequence that the tab 28 moves counterclockwise in the direction indicated by the arrow 64 appearing in FIG. 3. The effect of this thermal response in the coil 24 can be seen to have increased the lag between the rotary position of the damper plate 16 and the rotary position of the tab 28. Thus the effect of the increase in temperature of the coil 24 has been to move the tab 28 backwards toward the stop 30. FIG. 3 schematically illustrates the position of the tab 28 after combustion has continued sufficiently that the heat demand, manifested by the thermostatic control 58, has been satisfied. Upon satisfaction of its heat demand, the thermostatic control removes all power from the heating apparatus including the solenoid mechanism 54. This releases the armature 48 so that the return spring 52 is now permitted to return the armature 48 outwardly, thus causing the link 46 to transmit the force being applied by the spring 52 to the shaft 18, whereby the damper plate 16 commences a movement indicated by the arrow 66 appearing in FIG. 4 toward closure of the duct 14. This damper movement is promptly arrested, however, by abutment of the tab 28 against the stop 30. Thus the return force capabilities of the spring 52, while adequate to overcome any inertia associated with the damper plate 16, are small in relation to the mechanical strength of the bimetallic coil 24. Therefore, the force exerted by the spring 52 is decidedly small in relation to the forces that would be required to displace the coil 24 and the tab 28 from whatever position they occupy in response to the thermal forces applied thereto.

In view of the limited amount of rotary motion in the counterclockwise direction shown in FIG. 3 to be available to the tab 28 before it engages the stop 30, the damper closure motion initially accomplished under the power of the return spring 52 is only a few degrees as illustrated in FIG. 4. However, at this time, combustion has been terminated by an interruption of power produced by operation of the thermostatic control 58. With the power interruption, the delivery of fuel to the combustion apparatus has been terminated but the delivery of an atmosphere, especially oxygen, to the combustion apparatus has not been terminated. Thus, the draft produced by the combustion products upflowing the duct 14 functions to continually draw fresh air into the combustion zone of the combustion apparatus and when the flow of fuel to the combustion apparatus is interrupted, the continuing upflow of the last to have been produced combustion products causes fresh air to enter the duct 14 behind the combustion products.

Accordingly, upon termination of combustion, a condition develops which leads quickly to the coil 24 being bathed with relatively fresh air of a temperature substantially lower than the temperature of the combustion products which preceded the fresh air up the duct 14. Thus, promptly as the damper plate 16 is driven by the spring 52 to the position illustrated in FIG. 4, the coil 24 is contacted by relatively fresh air of a markedly lower temperature and as the coil 24 cools, the damper plate 16 is progressively closed in the direction illustrated by the arrow 66 in FIG. 4.

Clearly, what has happened is that the nonrotatable attachment of the coil 24, with its tab 28, to the damper plate 16 has operated to retard closure of the damper plate 16 until after relatively fresh air has replaced the combustion products that were earlier contacting the thermally responsive coil 24 and adjacent portions of the duct 14. Thus, damper closure has been delayed until after the combustion products have been fully removed from any access to the space heated by operation of the combustion apparatus.

This type of a thermal delay to damper closure, following the termination of combustion, is particularly desirable when used in association with combustion apparatus, such as an oil burner, because the products of oil burner combustion are generally regarded to be noxious when afforded access to the space being heated.

FIGS. 5 through 8 illustrate a modification of the present invention in which the thermal delay interposed to damper movement is utilized to delay damper opening as opposed to damper closing. This type of modification is acceptable, or at least tolerable, when the combustion products are essentially odorless, as in the case of natural fuel combustion and offers the advantage that the conservation of previously heated atmospheres can be maximized.

Figure 5:
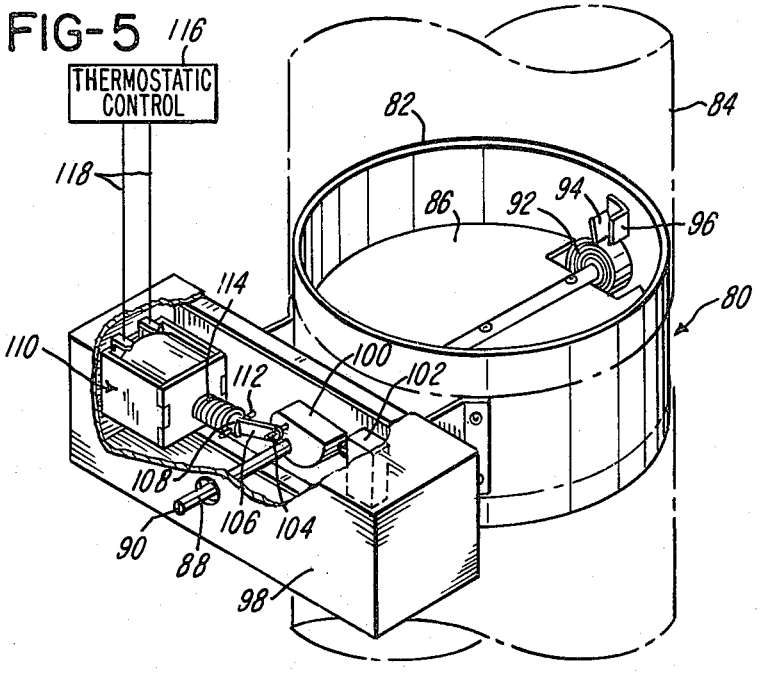
FIG. 5 is a perspective view with a portion broken away of a modification, an environmental duct being again shown with phantom lines and control apparatus again shown diagrammatically.

In FIG. 5 the modification, which has been identified by the reference number 80, is seen to comprise a housing 82 adapted to be inserted in a ventilation duct 84. Mounted for rotation within the housing 82 is a damper plate 86 riveted to a shaft 88, one end of which projects outboard of the housing 82 and the other end of which is bifurcated, as shown at 90 in FIG. 6, for interfitting attachment to the innermost convolution of a bimetallic heat responsive coil 92.

Projecting outwardly from the outermost convolution of the coil 92 is a tab 94 which, at times, engages a stop 96 attached by riveting to the inside wall of the housing 82.

Mounted by suitable rivets against the outside wall of the housing 82 is a box or shelter 98 through which the outboard end of the shaft 88 passes. Fixedly attached to the shaft 88, within the shelter 98, is a cam 100 adapted to engage, at times, a limit switch 102. A drive pin 104, press-fitted to the cam 100, is pivotally connected through a link 106 to the armature 108 of a solenoid mechanism 110. A retaining pin 112 traverses the bifurcated end of the armature 108. Confined about the armature 108 is an armature return spring 114 which bears at one end against the retaining pin 112 and at its opposite end against the core structure of the solenoid mechanism 110.

Operation of the solenoid mechanism 110 is controlled by a thermostatic control 116 connected to the solenoid mechanism 110 by conductors 118. The thermostatic control 116 is connected to a suitable source of electrical power, not shown. The thermostatic control operates at times to relay voltage from such source to the solenoid mechanism 110 so as to energize the same.

In addition to controlling energization of the solenoid mechanism 110, the thermostatic control 116 simultaneously controls the operation of a combustion apparatus, not shown, the combustion products of which are ventilated by the duct 84. For the purposes of this description, one can assume that the combustion apparatus is employed to heat a building structure and the thermostatic control 116 responds to the temperature of a space within the building.

FIG. 5 illustrates the modification 80 at a time long after any building heat demand has been satisfied and the building space monitored by the thermostatic control is slowly cooling. At such time, the thermostatic control is relaying an operating voltage over the conductors 118 which hold the solenoid mechanism 110 in an energized state, such that the armature 108 is retracted into the solenoid mechanism to hold the damper plate 86 in a duct closing position.

Figure 6:
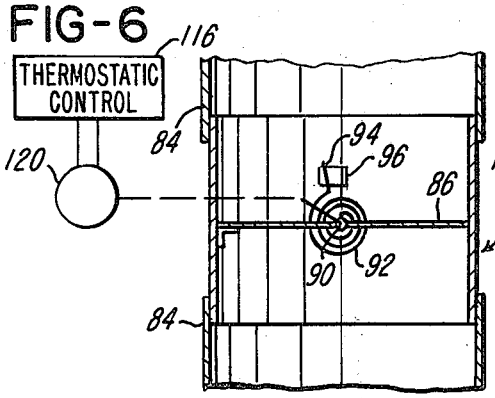

FIG. 6 is a sectional view illustrating the same operating condition as described in reference to FIG. 5 and in this Figure it can be noted that the illustration of the solenoid mechanism has been simplified so as to illustrate only a solenoid coil 120 and shows, by means of broken lines, that the damper plate 86 has been positioned by the then existing energization of the solenoid coil 120.

Ultimately, the progressive cooling of the space monitored by the thermostatic control 116, cools sufficiently that the thermostatic control de-energizes the solenoid mechanism 110. At the same time, the thermostatic control 116 also seeks to initiate operation of the combustion apparatus, not shown, by the transmittal of a combustion initiating power to the combustion apparatus. This application of power is initially blocked by the limit switch 102 because engaged by the cam 100.

Figure 7:
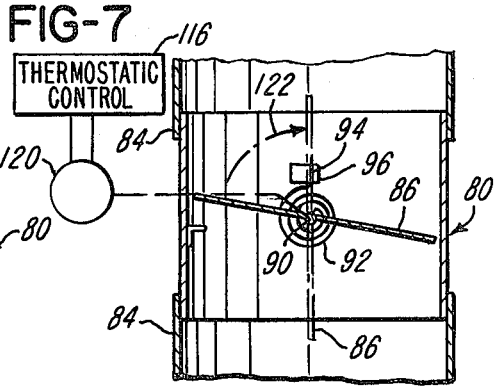

Promptly after the solenoid mechanism 110 is de-energized, the return spring 114 biases the armature 108 outwardly from the solenoid core structure and this outward bias transmitted through the link 106 opens the damper plate 86 to approximately the position illustrated in FIG. 7. This initial movement of the damper plate 86 in the clockwise direction, as viewed in FIG. 7, is stopped by engagement of the tab 94 against the stop 96. However, the positioning of the limit switch 102 in reference to the cam 100, has been predetermined in the design of the unit to allow the cam 100 to disengage the limit switch before the tab 94 engages the stop 96. Thus, the limited clockwise damper motion, illustrated in FIG. 7, is sufficient to release the limit switch 102 to allow the combustion initiating signal from the thermostatic control to commence combustion.

Promptly after the commencement of combustion, the temperature responsive coil 92 is bathed by combustion products flowing up the duct 84 and as the temperature of the coil 92 thereby increases, the tab 94 is driven by the coil 92 in the counterclockwise direction relative to the damper plate 86. Since the damper plate 86 remains subject to the bias of the return spring 114, the counterclockwise progression of the tab 94, relative to the damper plate 86, allows the return spring to progressively rotate damper plate 86 in the clockwise direction as shown by the arrow 122 in FIG. 7 and at a rate determined by the progressive heating of the coil 92.

Figure 8:
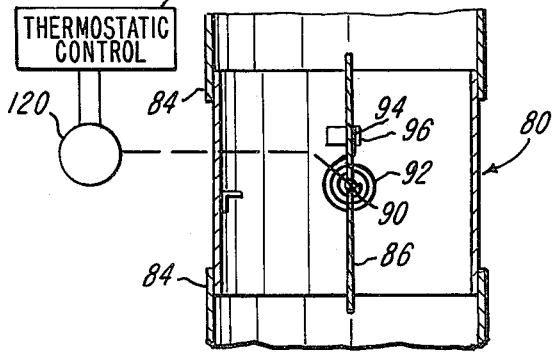

In time, as appears in FIG. 8, the progressive transfer of heat from the combustion products flowing through and around the thermostatic coil 92 may allow the damper plate 86 to assume the full open position wherein the damper plate rests against the tab 94, which in turn rests against the stop 96. At this time, the tab 94 has exhausted the range of counterclockwise movement relative to the damper plate 86, which was available to it, and the modulated opening of the damper plate powered by the return spring 114 terminates even though the demand for heat initiated by the thermostatic control 116 may not yet be satisfied. There accordingly may be a further delivery of heat from upflowing combustion products to the heat responsive coil 92 whereby the diameters of its several convolutions may continue to increase but the presence of the stop 96 prevents any overtravel of the damper plate 86 beyond its full open position.

With a continuing operation of the combustion apparatus, not shown, the heat demand of the thermostatic control 116 will, in time, be satisfied. Promptly upon being satisfied, the thermostatic control removes power from the combustion apparatus and simultaneously applies a power to the solenoid mechanism 110. The solenoid mechanism 110 promptly retracts its armature 108, with the consequence that the damper plate 86 is rotated in the counterclockwise direction, as viewed in FIG. 8, to close the duct 84. This conserves, as much as possible, the heated atmosphere contained in the space monitored by the thermostatic control.

Promptly after the thermostatic control functions in response to satisfaction of its heat demand to energize the solenoid mechanism 110, the cam 100 also releases the limit switch 102 to terminate further combustion. While the substantial coincidence between closure of the damper plate 86 and the termination of combustion may momentarily trap some combustion product under the damper plate 86, it is to be appreciated that the continuing upflow of combustion products within the duct 84, above the damper plate, has established a strong updraft which acts quickly to suck any combustion products remaining under the damper plate 86 through and around the convolutions of the coil 92 and upwardly into portions of the duct 84 disposed above the closed damper plate 86. The continuing updrat draws relatively fresh air over the combustion apparatus, not shown, and up the duct 84 and, since the preponderance of this air flow contacts the convolutions of the coil 92 and interior wall portions of the duct 84, this coil is quickly cooled to approximate room temperature. As the bimetallic coil 92 is thus quickly cooled, the tab 94, which may have been moved counterclockwise nearly 90° upon energization of the solenoid mechanism 110, thermally recovers approximately 80° of its clockwise motion by reason of a progressive counterclockwise motion of the tab as the coil 92 cools. Since cooling of the coil 92 is being expedited by the updraft drawing fresh air over the thermally responsive coil, a restoration of the damper assembly to the condition illustrated in FIG. 6 can ordinarily be expected before a renewed damand for heat is manifested by the thermostatic control 116. Of course, should a renewed demand for heat occur before the tab 94 has reached the position illustrated in FIG. 7, this will simply mean that the initial opening of the damper plate 86 will proceed greater in the clockwise direction than appears in FIG. 7.

In either of the foregoing embodiments conditions may develop in which the movement of the damper plate has been blocked, such as, for example, by the weight of fallen masonry or a dead bird resting on the damper plate. It is therefore recommended that a vent safety switch, such as disclosed in Quick et al U.S. Pat. No. 3,542,018, be combined with the flue duct or with the combustion apparatus. Such vent safety switch can operate to detect a failure of the damper to open which results in a consequent build-up of combustion products under the damper plate. A vent safety switch, when used, is connected, as known, with the fuel supply valve, not shown, so as to terminate the delivery of fuel to the combustion apparatus upon failure of the damper to open at times when the occurrence of combustion would require that the damper be open.

In the preferred embodiment of this invention described in reference to FIGS. 1–4 and also the modification described in reference to FIGS. 5-8, the limit switch has been described as a switch which is necessarily actuated by a cam before combustion can be commenced. Thus, the limit switch is described as a device which proves that the damper has opened before combustion is permitted to commence. Those skilled in the art will appreciate, however, that the commencement of combustion may be placed directly under control of the thermostatic control and the limit switch arrangements, earlier described, may perform other functions such as, for example, interrupting combustion. More particularly, the use of a cam and limit switch, such as disclosed in this application, are essentially optional features whose presence or absence depend upon the nature of the combustion control apparatus being employed.

Although the preferred embodiments of this invention have been described, it will be understood that various changes may be made within the scope of the appended claims.

Having thus described my invention, I claim:

1. In a damper control mechanism of the type comprising a damper movable from a first position substantially closing a duct to a second position substantially opening said duct, yieldable means for biasing said damper to one of said first and second positions, motive means energizable to drive said damper against the bias of said yieldable means toward the other of said positions, and said duct having stop means for stopping said damper in one of said first and second positions, the improvement comprising thermally responsive means disposed in said duct and engaged to one of said damper and said stop means, said thermally responsive means having tab means engagable with the other of said damper and said stop means, said thermally responsive means exposed to matter passing through said duct for modulating the movement of said damper in response to the bias of said yieldable means.

2. The improvement of claim 1 wherein said thermally responsive means comprises a convoluted coil having respectively innermost and outermost convolutions, wherein said tab means is a portion of said outermost convolution, and including means drivingly connecting said innermost convolution with said damper.

3. The improvement of claim 2 wherein said means drivingly connecting said innermost convolution with said damper comprises shaft means affixed to said damper and having a slot at one end thereof interfitting a portion of said innermost convolution.

4. The improvement of claim 1 wherein said damper has a surrounding periphery whose shape and size approximately equal the shape and size of said duct, said periphery having a notch receiving said thermally responsive means.

5. The improvement of claim 1 wherein said thermally responsive means is affixed to said damper, said motive means, when energized, drives said damper to said first position and said yieldable means when said motive means is de-energized drives said damper towards said second position, said tab means positioned to engage said stop means as said yieldable means moves said damper to said second position.

6. The improvement of claim 1 wherein said thermally responsive means is affixed to said damper, said motive means drives said damper against the bias of said yieldable means to said second position, and said tab means is positioned to engage said stop means as said damper moves toward said first position.

7. In a mechanism for controllably venting gases from the flue of a combustion apparatus, said mechanism comprising a housing for mounting to said flue and into which said gases pass, a damper mounted in said housing and movable between a first position opening said housing for the passage of gases therefrom and a second position substantially closing said housing against the passage of gases therethrough, yieldable means biasing said damper to one of said first and second positions, motive means for holding said damper against the bias of said yieldable means in the other of said first and second positions, and a thermostatic control means in circuit with said motive means for disabling said motive means in response to a thermal condition sensed by said control means, the improvement wherein said housing has a stop member for arresting the movement of said damper, and including thermally responsive means exposed to gases passing through said housing for modulating the movement of said damper in response to the bias of said yieldable means.

8. The improvement of claim 7 wherein said motive means when energized drives said damper to said second position and when said motive means is de-energized, said yieldable means biases said damper toward said first position, said thermally responsive means responding to the temperature of gases in said housing to modulate the motion of said damper toward said first position.

9. The improvement of claim 7 wherein said motive means when energized drives said damper to said first position and when said motive means is de-energized, said yieldable means biases said damper toward said second position, said heat responsive means responding to the temperature of gases in said housing to modulate the motion of said damper toward said second position.

10. The method of thermally modulating the movement of a damper within a duct which comprises providing said duct with means for stopping the movement of said damper at one position of the available damper movement, and interposing between said damper and said stop means a thermally responsive element which responds to the temperature of products within said duct to modulate movement of said damper relative to said stop means.

* * * * *

UNITED STATES PATENT AND TRADEMARK OFFICE

CERTIFICATE OF CORRECTION

PATENT NO. : 4,290,552

DATED : September 22, 1981

INVENTOR(S) : John Prikkel, III

It is certified that error appears in the above-identified patent and that said Letters Patent are hereby corrected as shown below:

Column 1, line 38, "alllow" should read ---allow---

Claim 9, line 45, "heat" should read ---thermally---

Signed and Sealed this

*Twenty-second* Day of *December 1981*

[SEAL]

*Attest:*

GERALD J. MOSSINGHOFF

*Attesting Officer*

*Commissioner of Patents and Trademarks*